US005521339A

United States Patent [19]

Despain et al.

[11] Patent Number: 5,521,339

[45] Date of Patent: May 28, 1996

[54] CATALYST MUFFLER SYSTEM

[75] Inventors: Michael S. Despain; Kevin F. Beaulieu; Kim Liechty, all of Shreveport, La.

[73] Assignee: WCI Outdoor Products, Inc., Cleveland, Ohio

[21] Appl. No.: 342,331

[22] Filed: Nov. 18, 1994

[51] Int. Cl.[6] ..... F01N 3/02

[52] U.S. Cl. ..... 181/230; 181/231; 181/265; 181/282; 60/299

[58] Field of Search ..... 181/230, 231, 181/240, 265, 282, 283; 60/299, 302

[56] References Cited

U.S. PATENT DOCUMENTS

| | | | |
|---|---|---|---|
| 4,050,903 | 9/1977 | Bailey et al. . | |
| 4,142,607 | 3/1979 | Landwehr et al. . | |
| 4,164,989 | 8/1979 | Lux et al. . | |
| 4,332,220 | 6/1982 | Itzrodt . | |
| 4,370,855 | 2/1983 | Tuggle . | |
| 4,579,194 | 4/1986 | Shiki et al. . | |
| 4,693,337 | 9/1987 | Timmermeister | 181/231 |
| 4,848,513 | 7/1989 | Csaszar | 181/258 X |
| 4,867,270 | 9/1989 | Wissmann et al. . | |
| 4,890,690 | 1/1990 | Fischer et al. . | |
| 5,014,510 | 5/1991 | Laimbock . | |
| 5,043,147 | 8/1991 | Knight | 181/258 X |
| 5,048,290 | 9/1991 | Lavenius et al. . | |
| 5,177,962 | 1/1993 | Hall et al. | 181/231 X |
| 5,206,467 | 4/1993 | Nagai et al. . | |
| 5,315,075 | 5/1994 | Junginger et al. . | |
| 5,338,903 | 8/1994 | Winberg | 181/231 |

*Primary Examiner*—Khanh Dang

*Attorney, Agent, or Firm*—Pearne, Gordon, McCoy & Granger

[57] ABSTRACT

A muffler for coupling to an exhaust port of an internal combustion engine includes a housing, a first hollow body within the housing, a catalyzer within the first hollow body, and a second hollow body within the housing. The first hollow body has an inner surface defining a first chamber and an inlet adjacent the exhaust port to admit the exhaust gas into the first chamber. The exhaust gas is exothermally treated as it flows through the catalyst in the first chamber in a direction away from the engine and passes through an outlet of the first hollow body to a second chamber. The second chamber is formed by an inner surface of the second hollow body and an outer surface of the first hollow body. The treated exhaust gas flows through the second chamber in a direction toward the engine over the outer surface of the first hollow body where a thermal reaction takes place and/or further emission reduction takes place by a catalytic coating on the outer surface of the first hollow body. The treated exhaust gas passes through an outlet of the second hollow body to a third chamber. The third chamber is formed by an outer surface of the second hollow body and an inner surface of the housing. After expanding and mixing in the third chamber, the exhaust gas is expelled from the third chamber through an outlet of the housing adjacent the engine.

31 Claims, 4 Drawing Sheets

Fig.2
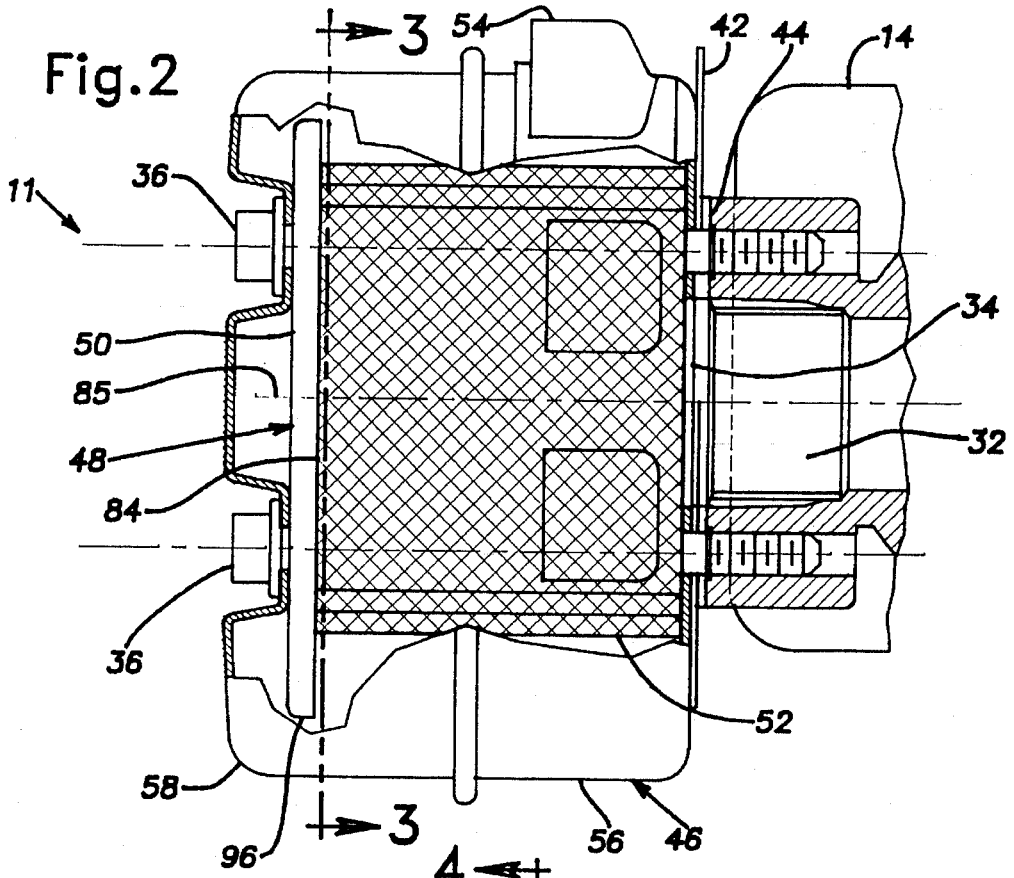
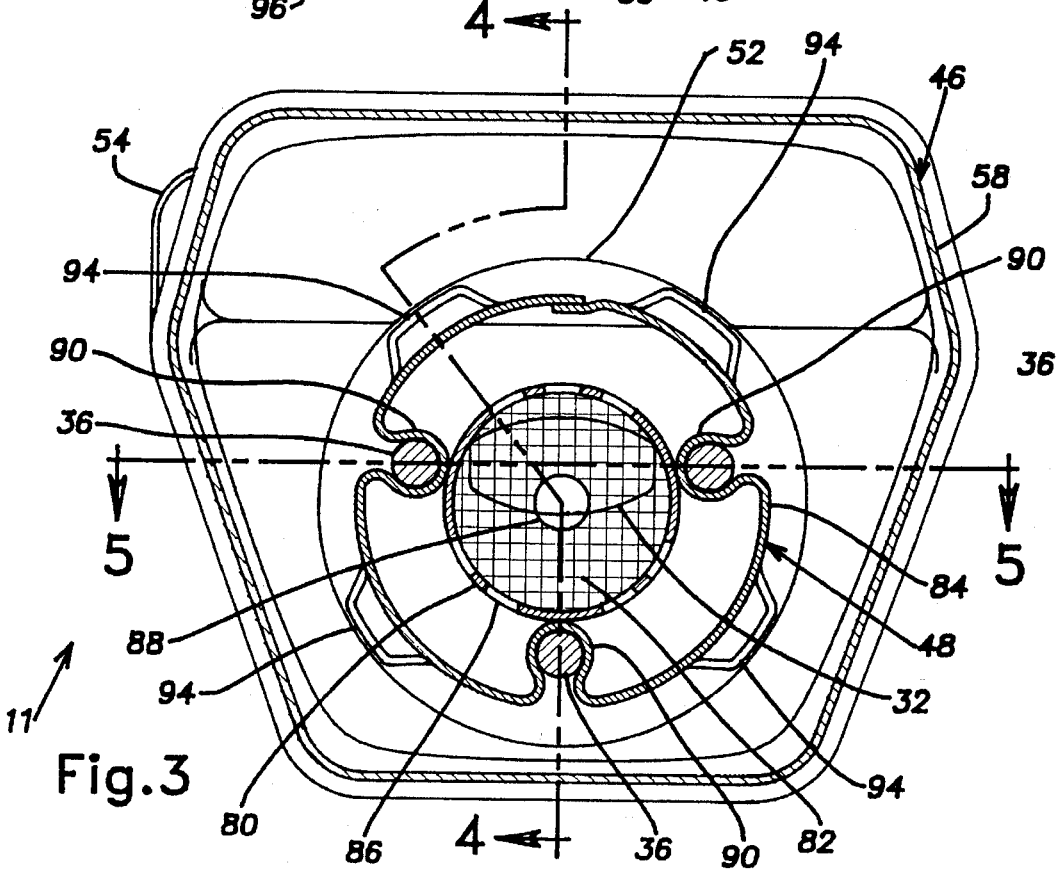
Fig.3

11
105
54
46
68
42
16
44
104
32
34
14
36

CATALYST MUFFLER SYSTEM

BACKGROUND OF THE INVENTION

1. Field of the Invention

The present invention relates to mufflers for internal combustion engines and, more particularly, to a catalyst muffler system for an internal combustion engine used on portable tools such as air blowers, flexible line trimmers, edgers, chain saws, and the like.

2. Description of Related Art

It is known to use a catalytic element or catalyzer in a muffler for a small two-cycle internal combustion engine used on portable tools to reduce noxious components of exhaust gas, such as hydrocarbons and carbon monoxide. An exothermal chemical conversion takes place in the catalyzer where, for example, hydrocarbons are converted to carbon dioxide and water. The exhaust gas typically enters the catalyzer with a temperature of approximately 600 degrees centigrade (C.). The conversion causes the temperature of the exhaust gas to increase in the catalyzer to about 1000 degrees C.

Typically the catalyzer is relatively small because the mufflers used on portable tools must be compact and light weight. Because the catalyzer is small, and the exhaust gas is typically energy rich for two-stroke engines, a complete conversion of the noxious components of the exhaust gas is not obtained. This is particularly a problem with regulations requiring increasingly low exhaust emission output levels. Additionally, the exhaust gas can ignite if it reaches ambient air containing oxygen, through the exhaust outlet or through a gap at the partition interface of the muffler housing, at temperatures high enough for ignition. In hand-held portable tools, operating personnel can be endangered by both high temperature exhaust gas and ignition of exhaust gas.

U.S. Pat. No. 4,867,270, the disclosure of which is herein expressly incorporated in its entirety, discloses a muffler for a two-stroke engine having a catalyzer. The catalyzer is located in a gas tight hollow body mounted in a housing so as to be spaced on all sides from the housing walls. The untreated exhaust gas passes over a portion of the exterior surface of the hollow body to cool the hollow body before entering the hollow body and passing through the catalyzer. The hollow body has an outlet portion tapered in the direction of flow to reduce self ignition of the hot treated exhaust gas.

U.S. Pat. No. 4,890,690, the disclosure of which is herein expressly incorporated in its entirety, discloses a muffler for a two-stroke engine having a catalyzer. The catalyzer and a partition wall establish two chambers in a housing. The exhaust gas enters the first chamber and passes through the catalyzer into the second chamber. The treated exhaust gas leaves the housing through an outlet in the second chamber. The partition wall is located downstream of an interface of the housing so that the treated exhaust gas cannot get back to the interface. The partition wall includes a bypass hole so that a portion of the exhaust gas can bypass the catalyzer.

U.S. Pat. No. 5,048,290, the disclosure of which is herein expressly incorporated in its entirety, discloses a muffler for a two-stroke engine having a catalyzer. The catalyzer is located in a tube spaced within a muffler housing. An inner end of the tube facing the engine exhaust port is closed by a convex perforated plate so that there is less heat transmission to the engine. The outer end of the tube is closed by a lid with cooling plates. The exhaust gas enters the housing and passes into the catalyzer through the perforated plate.

After passing through the catalyzer, the exhaust gas is deflected by the lid through an opening in the side of the tube to an outlet tube.

While these mufflers may reduce exhaust gas exit temperature or muffler housing surface temperature, they may have relatively high exhaust emission output levels. Accordingly, there is a need for a compact and light weight muffler for a two-stroke engine having a relatively low exhaust emission output level and relatively low exhaust gas exit temperature and muffler housing surface temperature. Additionally, the muffler should provide good noise reduction, maintain good engine performance, and be reliable, inexpensive, and easy to manufacture.

SUMMARY OF THE INVENTION

The present invention provides a muffler for coupling to an exhaust port of an internal combustion engine that solves the above-noted problems of the related art. The muffler according to the invention includes a housing, a first hollow body within the housing, and a catalyzer within the first hollow body for exothermally treating exhaust gas. The first hollow body has an inner surface that forms a first chamber and an outer surface that forms a second chamber. An inlet is provided in the first hollow body for communicating the first chamber with the exhaust port to admit the exhaust gas into the first chamber. The first hollow body is also provided with an outlet for passing gas from the first chamber to the second chamber. The second chamber is provided with an outlet opposite the outlet of the first hollow body such that treated exhaust gas within the second chamber flows substantially across the outer surface of the first hollow body in the second chamber to reach the second chamber outlet.

BRIEF DESCRIPTION OF THE DRAWINGS

These and further features of the present invention will be apparent with reference to the following description and drawings, wherein:

FIG. 2. is a fragmentary plan view, partially in cross-section, of the muffler;

FIG. 3 is a sectional view, taken along line 3—3 of FIG. 2, of the muffler;

DETAILED DESCRIPTION OF THE PREFERRED EMBODIMENT

Figure 1:
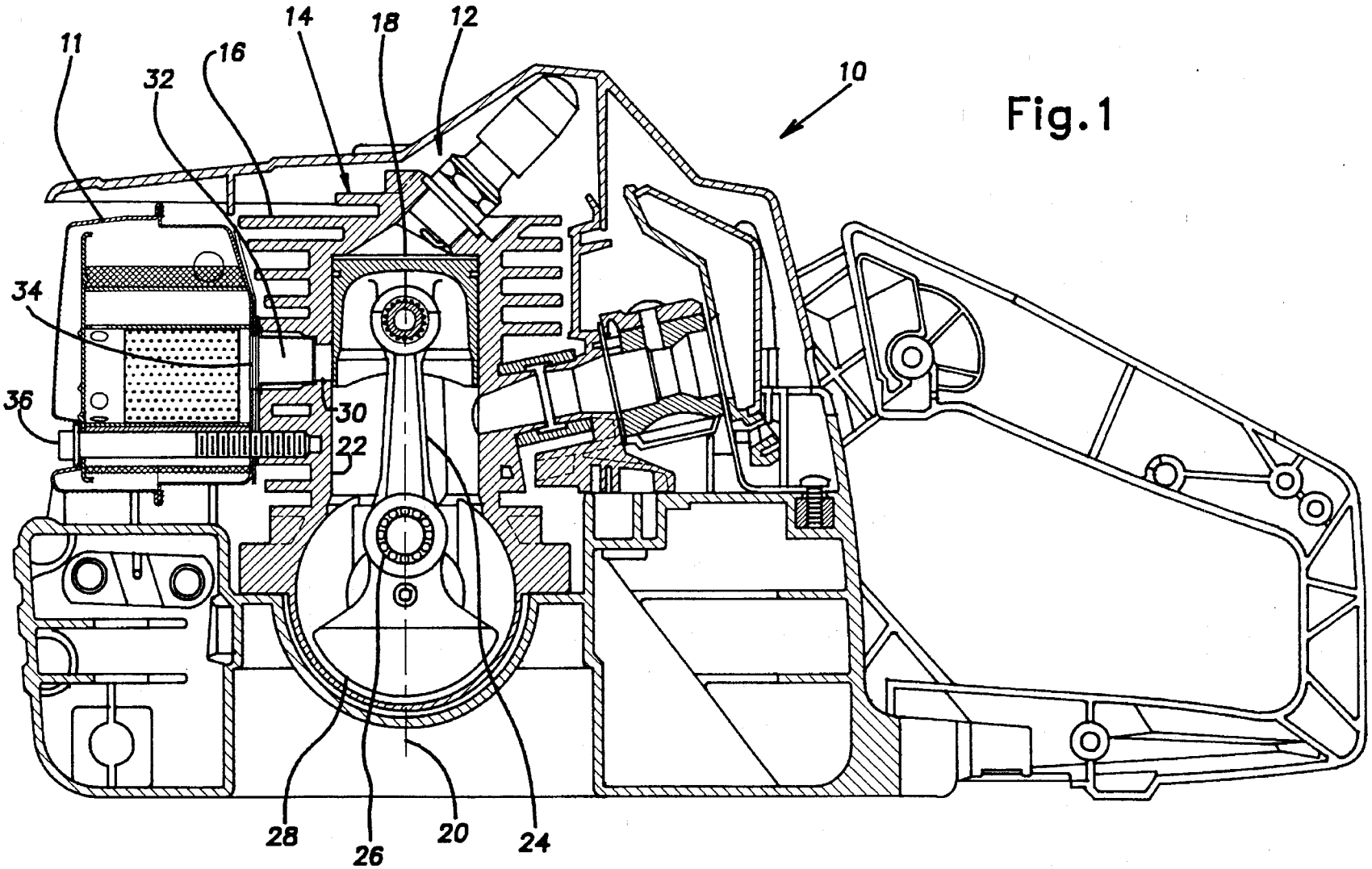
FIG. 1 is an elevational view, in cross-section, of a power head of a portable tool with a two-cycle internal combustion engine and a muffler according to the present invention.

FIG. 1 illustrates a power head 10 of a portable tool, particularly a chain saw, including a muffler 11 according to the present invention. The power head 12 is intended to be representative of power heads for portable tools in general that are powered by internal combustion engines such as, for example, line trimmers, blowers, hedge trimmers, edgers, lawn mowers, chain saws, and snow throwers.

The power head 10 is powered by a two-cycle, single cylinder, air cooled internal combustion engine 12. The engine 12 includes a cylinder 14 provided with a plurality of externally disposed cooling fins 16. Preferably, the cylinder 14 is made substantially of aluminum which is lightweight and has a high thermal conductivity so that heat from the interior of the cylinder 14 will be transferred to the cooling fins 16. In a conventional manner a piston 18 reciprocates generally along an axis 20 within a bore 22 of the cylinder 14. The reciprocating movement of the piston 18 is translated into rotation of a crankshaft about the axis 20 by a rod 24 turning a crank pin 26. The crankshaft is obscured by a counterweight 28 and the crank pin 26.

The top edge of the piston 18 controls the opening and closing of a window 30 to an exhaust port 32. The exhaust port 32 is directly coupled to an inlet 34 of the muffler 11. Exhaust gas from the bore 22 is discharged through the exhaust port 32 and directed into the muffler 11 through the inlet 34. The muffler 11 is fastened directly to the cylinder 14 using mounting bolts 36. Other types of fasteners or retention methods, such as springs, may be used.

Figure 4:
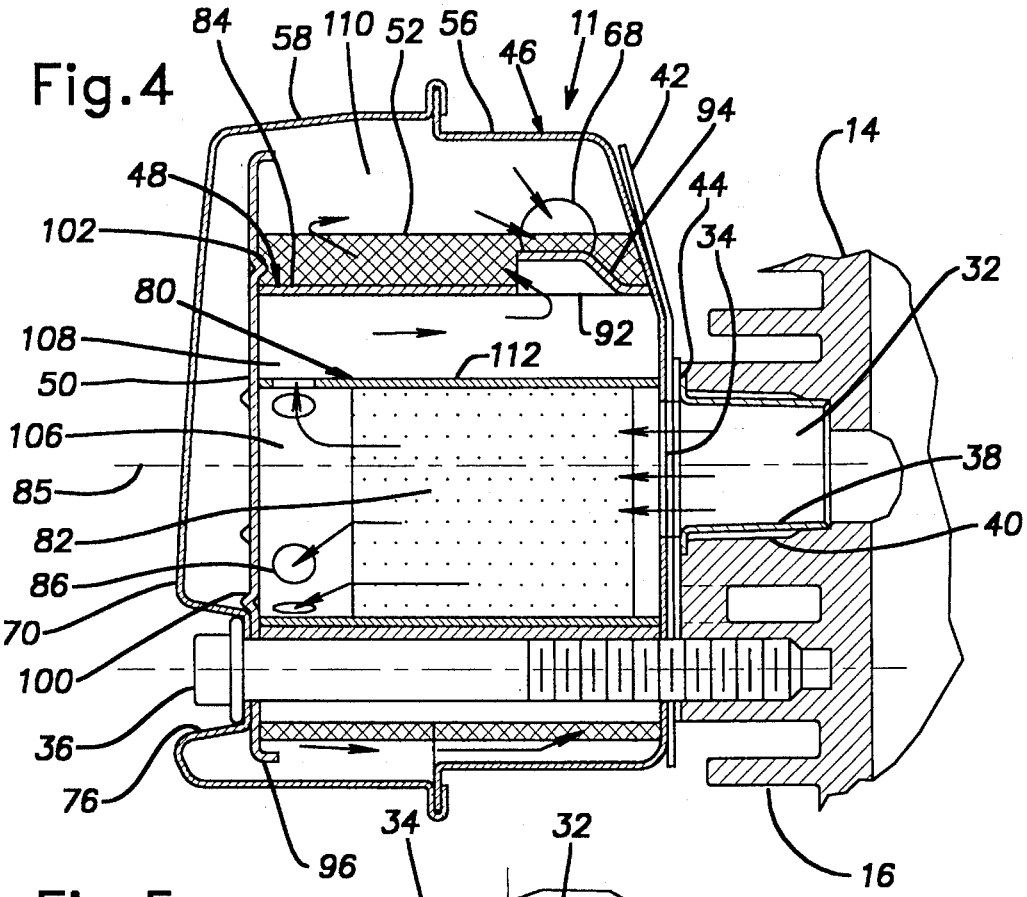
FIG. 4 is a sectional view, taken along line 4—4 of FIG. 3, of an exhaust gas flow path through the muffler.

As best seen in FIG. 4, the exhaust port 32 is lined with a steel sleeve 38 to form an air gap 40 circumscribing the sleeve 38. The sleeve 38 and the air gap 40 have lower coefficients of heating than the cylinder 14. The sleeve 38 and the air gap 40 thus act as insulators to slow the rate of heat transference from the exhaust gas to the walls of the cylinder 14. U.S. patent application Ser. No. 08/072,164 now U.S. Pat. No. 5,438,825, the disclosure of which is expressly incorporated herein in its entirety, should be consulted for more information on such sleeves.

A heat shield 42 is located between the muffler 11 and the cylinder 14 to reduce heat radiating from the muffler 11 to the cylinder 14. The heat shield 42 is preferably made of aluminum for good heat dissipation. The heat shield 42 includes an exhaust opening which is aligned during assembly with the exhaust port 32 and the muffler inlet 34 to allow passage of the exhaust gas. The bolts 36 retaining the muffler 11 against the cylinder 14 extend through openings in the heat shield 42 to retain the proper alignment. The surface of the heat shield 42 is preferably generally equal to the muffler 11 so that it does not obstruct the flow of cooling air past the cylinder 14 and muffler 11.

The heat shield 42 is spaced apart from the cylinder 14 by an insulator or gasket 44 to introduce a layer of air between the heat shield 42 and the cylinder 14 to slow transmission of heat to the cylinder 14. The gasket 44 is preferably made of steel or other materials providing some degree of insulation. The gasket 44 includes an exhaust opening which is aligned during assembly with the exhaust port 32, the exhaust opening of the heat shield, and the muffler inlet 34 to allow passage of the exhaust gas. The bolts 36 retaining the muffler 11 against the cylinder 14 extend through openings in the gasket 44 to retain the proper alignment.

As seen in FIGS. 2–6, the muffler 11 includes a housing 46, a catalyst tube assembly 48, a reflector 50, a flame arrestor screen 52, and an exhaust outlet deflector or louver 54. The muffler housing 46 is made of first and second oppositely concave complementary shell members 56, 58. The shell members 56, 58 are formed by stamping a rigid material such as sheet metal. The material must be capable of withstanding extreme temperatures of the exhaust gas generated by the engine.

Figure 5:
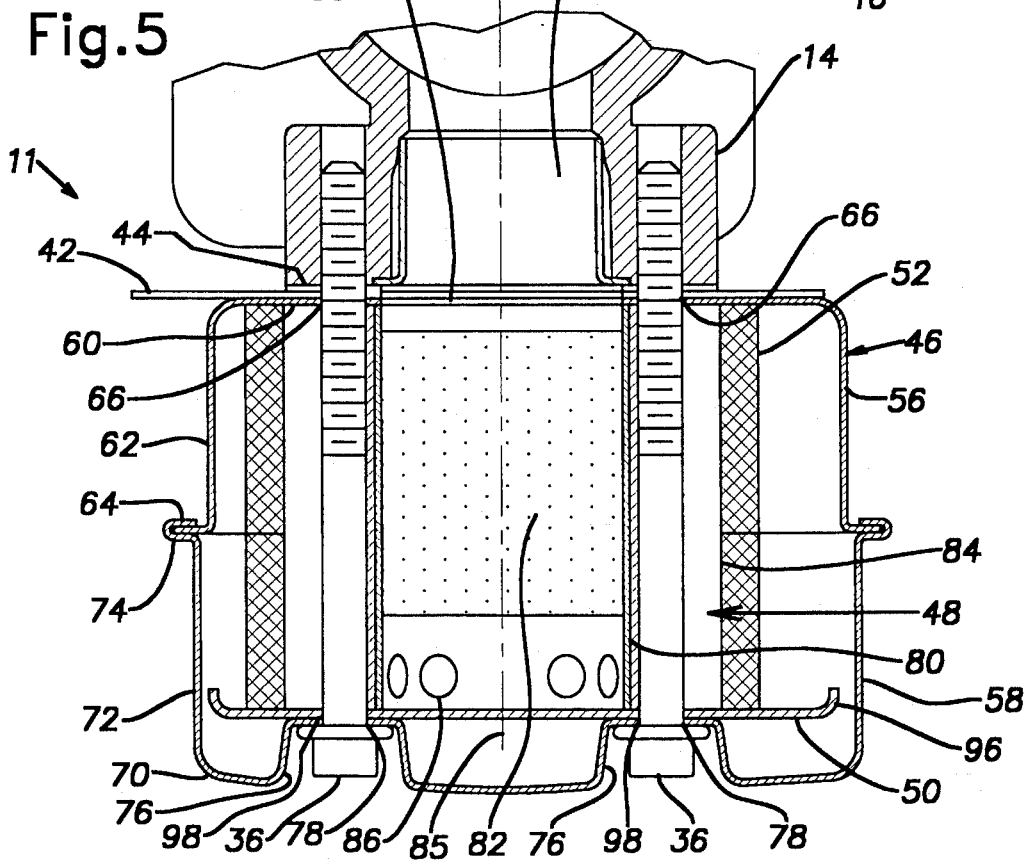
FIG. 5 is a sectional view, taken along line 5—5 of FIG. 2, of the muffler.

As seen in FIG. 5, the first shell member 56 includes a back wall 60, a side wall 62, and a flange 64. The muffler inlet 34 is located in the back wall 60 such that it is in fluid communication with the exhaust port 32. The back wall 60 also includes openings 66 for the mounting bolts 36. The side wall 62 perpendicularly extends from the periphery of the back wall 60. A muffler outlet 68 (FIG. 4) is located in the side wall 62 generally adjacent the back wall 60 at an upper portion of the first shell member 56. The flange 64 outwardly extends from an outer end of the side wall 62 opposite the back wall 60.

The second shell member 58 includes a front wall 70, a side wall 72, and a flange 74. Three recesses 76 are formed in the front wall 70 and have openings 78 for the mounting bolts 36. The side wall 72 perpendicularly extends from the periphery of the front wall 70. The flange 74 outwardly extends from an end of the side wall 72 opposite the front wall 70 and is crimped around the flange 64 of the first shell member 56 to attach the shell members 56, 58 in a gas tight manner and hold the muffler 11 together. The shell members 56, 58 could alternatively be attached by other attaching means having a gas tight seal such as, for example, welding or mechanical fasteners.

The housing 46 could alternatively have a double wall. The double wall could comprise an inner wall and an outer wall spaced from the inner wall to form an air gap. The air gap could be filled with a high-temperature resistant insulating material. The double walled housing reduces the skin temperature on the outside surface of the housing 46 by reducing the ability of the heat to transfer from the inside of the housing 46.

As best seen in FIGS. 3–5, the catalyst tube assembly 48 is held within the housing 46 and includes a first hollow body 80, a catalyzer 82, and a second hollow body 84. Each component of the catalyst tube assembly are formed by stamping a rigid material such as sheet metal or other material that is capable of withstanding the extreme temperatures of the exhaust gas. A central axis 85 of the catalyst tube assembly 48 is coaxial with the exhaust port 32. The first hollow body 80 is tubularly-shaped having a length sized to extend substantially from the back wall 60 of the first shell member 56 to the reflector 50. The first hollow body 80 has a diameter sized to encircle the muffler inlet 34. A plurality of outlets 86 are spaced about the circumference of the first hollow body 80 adjacent an outer end of the first hollow body 80 close to the front wall 70 of the second shell member 58 and opposite the inlet 34. As shown in FIG. 3, the illustrated embodiment includes seven circularly shaped outlets 86: four equally spaced about the bottom of the first hollow body 80; and three equally spaced about the top of the first hollow body 80.

As seen in FIGS. 3–5, the catalyzer 82 is located within the first hollow body 80 at an inner end of the first hollow body 80 adjacent the inlet 34 and opposite the outlets 86. The catalyzer 82 is generally sized to fill the full cross-section of the first hollow body 80, but preferably includes an axially extending opening 88 at the central axis 85 of the catalyst tube assembly 48. Alternatively, a plurality of axially extending openings could be provided.

The second hollow body 84 is tubularly-shaped having a length generally equal to the length of the first hollow body 80 and surrounds the first hollow body 80. The second hollow body 84 has a diameter larger than the diameter of the first hollow body 80. As best seen in FIG. 3, three radially inwardly extending recesses 90 are formed in the second hollow body 84. The recesses 90 are spaced on the circumference of the second hollow body 84 and are sized for accepting the mounting bolts 36. The recesses 90 and the diameter of the second hollow body 84 are sized such that the first hollow body 80 is centered and held in alignment with the central axis 85 of the catalyst tube assembly 48. As best seen in FIG. 4, outlets 92 are spaced about the circumference of the second hollow body 84 at the inner end of the second hollow body 84 adjacent the muffler inlet 34. The illustrated embodiment includes four of the outlets 92 spaced around the circumference of the second hollow body 84. Formed at each of the outlets 92 is a deflector or louver 94 shaped for directing the exhaust gas exiting the outlets 92 in a direction toward the outer end of the second hollow body 84 opposite the muffler inlet 34.

The reflector 50 is generally planar, and has a shape substantially equal to the cross-section of the second shell member 58. The reflector 50 is formed by stamping a rigid material such as sheet metal or other material that is capable of withstanding the extreme temperatures of the exhaust gas. A generally perpendicularly extending lip 96 is provided at the periphery of the reflector 50. The reflector 50 includes openings 98 for the mounting bolts 36. As best seen in FIG. 4, arcuate first ridges 100 are formed in the reflector 50 and extend from an outer surface of the reflector 50. The first ridges 100 are sized and shaped to cooperate with the recesses 76 in the front wall 70 of the-second shell member 58 to position the reflector 50 within the housing 46. The recesses 76 of the front wall 70 of the second shell member 58 space the reflector 50 from the front wall 70 to reduce the temperature of the front wall 70 by preventing the exhaust gas from directly contacting the front wall. Arcuate second ridges 102 are formed in the reflector 50 and extend from an inner surface of the reflector 50. The second ridges 102 are sized and shaped to cooperate with the second hollow body 84 to locate the catalyst tube assembly 48 centrally within the housing 46.

The flame arrestor screen 52 is generally tubularly-shaped having a length substantially equal to the second hollow body 84. The flame arrestor screen 52 has a diameter slightly larger than a diameter formed by outer surfaces of the louvers 94 of the second hollow body 84 so that the flame arrestor screen 52 is coaxial with the first and second hollow bodies 80, 84. The flame arrestor screen 52 is preferably made of stainless steel mesh having openings of 0.020 inches or smaller.

Figure 6:
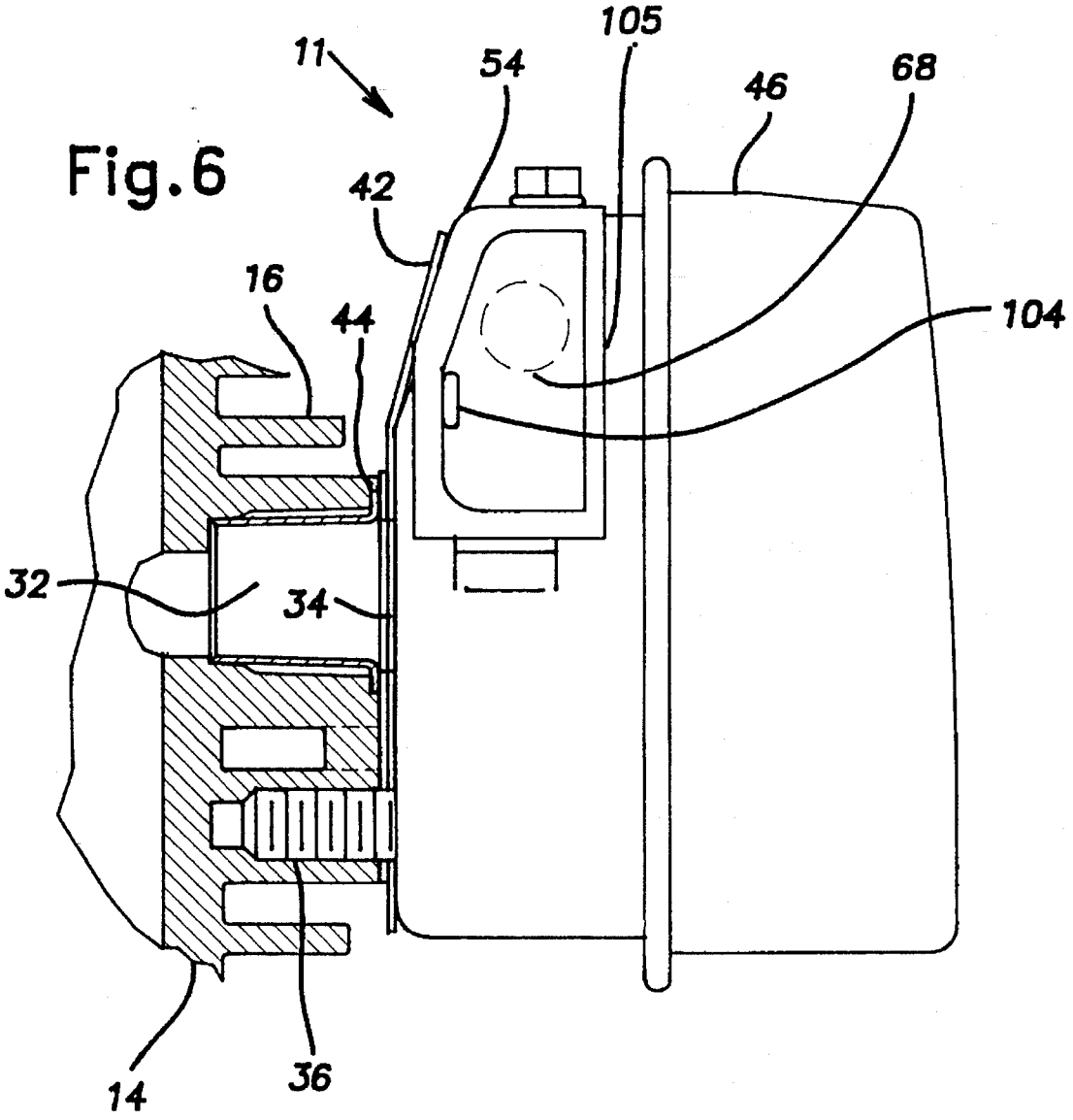
FIG. 6 is a fragmentary elevational view, partially in cross-section, of an exhaust outlet of the muffler.

The exhaust outlet louver 54 is attached to the housing 46 adjacent the exhaust outlet 68 in the first shell member 56 of the housing 46. The louver 54 is shaped for directing the exhaust gas exiting the exhaust outlet 68 in a direction away from the engine cylinder 14. As shown in FIG. 6, an opening 104 is located in the exhaust outlet louver 54 to admit ambient air into a low pressure zone in the louver 54 created by the exiting exhaust gas. The ambient air mixes with the exhaust gas to lower the temperature of the exiting exhaust gas. The exhaust outlet louver 54 or the exhaust outlet 68 is also provided with a spark arrestor screen. The spark arrestor screen 105 is preferably made of stainless steel mesh having openings of 0.020 inches or smaller.

The muffler 11 is assembled by placing the catalyst tube assembly 48 in the first shell member 56 such that the inner end of the first hollow body 80 and the inner end of the second hollow body 84 each abut the back wall 60 of the first shell member 56. The flame arrestor screen 52 is placed around the catalyst tube assembly 48 and against the back wall 60 of the first shell member 56. The reflector 50 is positioned to abut and close the outer end of the first hollow body 80 and the outer end of the second hollow body 84. The outer end of the second hollow body 84 is positioned within the second ridges 102 of the reflector 50 to position and orient the catalyst tube assembly 48 relative to the reflector 50. The second shell member 58 is placed over the reflector 50 and positioned with the recesses 76 within the first ridges 100 of the reflector 50 to position and orient the reflector 50 relative to the housing 46. The flange 74 of the second shell member 58 is crimped to the flange 64 of the first shell member 56. The shell members 56, 58 thus clamp the catalyst tube assembly 48, the reflector 50, and the flame arrestor screen 52 in position.

As best seen in FIG. 4, the muffler 11 has first, second, and third chambers 106, 108, 110. The first chamber 106, which is cylindrically-shaped, is defined by an inner surface of the first hollow body 80, the reflector 50, and the back wall 60 of the housing 46. The second chamber 108, which is annularly shaped, is defined by an outer surface 112 of the first hollow body 80, an inner surface of the second hollow body 84, the reflector 50, and the back wall 60 of the housing 46. The third chamber 110 is defined by an outer surface of the second hollow body 84, the reflector 50, and an inner surface of the housing 46.

As illustrated in FIG. 4, the exhaust gas flows through the inlet 34, adjacent the exhaust port 32, and into the first chamber 106 at a temperature of about 600 degrees C. In the first chamber 106 the exhaust gas enters and flows through the catalyzer 82 in a direction away from the engine cylinder 14. In the catalyzer 82 initial emission reduction occurs. After passing through the catalyzer 82, the exhaust gas exits the first chamber 106 in a radial direction through the outlets 86, remote from the inlet 34 and the exhaust port 32, and enter the second chamber 108. The exhaust gas exits the catalyzer 82 at a very high temperature compared to its temperature upon entering the catalyzer 82, typically from about 900 to about 1000 degrees C. The reflector 50 closes off the outer end of the first chamber 106 and prevents the hot treated exhaust gas from contacting the front wall 70 of the second shell member 58 to maintain a relatively low surface temperature at the front of the muffler 11.

In the second chamber 108 the exhaust gas is directed back toward the engine cylinder 14 such that it flows over the entire periphery of the outer surface 112 of the first hollow body 80, which is very hot. The second chamber is a relatively narrow annularly-shaped flow path for the exhaust gas. An additional emission reduction occurs in the second chamber 108 by a thermal reaction due to the high temperature of the outer surface 112 of the first hollow body 80. The temperature required to continue combustion in the second chamber 108 is at least about 750 degrees C. It can be further advantageous to provide a catalytic coating on the outer surface 112 of the first hollow body 80 to obtain further emission reduction in the second chamber 108.

The exhaust gas exits the second chamber 108 through the outlets 92 of the second hollow body 84, adjacent the engine cylinder 14, and enters the third chamber 110. The louvers 94 of the second hollow body 84 direct the exhaust gas in a direction away from the engine cylinder 14. The exhaust gas passes through the flame arrestor screen 52 to help insure that no flames exit the muffler 11. Within the third chamber 110 the exhaust gas is expanded and thoroughly mixed. The exhaust gas exits the housing 46 by passing through the muffler outlet 68 into the exhaust outlet louver 54. As the exhaust gas passes through the orifice in the exhaust outlet louver 54, the low pressure zone is created and ambient air is drawn into the exhaust outlet louver 54 through the opening 104 and mixes with the exhaust gases to further cool the exhaust gases. The exhaust gas exits the exhaust outlet louver 54 and the spark arrestor screen 105 and is expelled into the atmosphere in a direction away from the cooling fins 16 of the engine cylinder 14.

Although a particular embodiment of the invention has been described in detail, it will be understood that the invention is not limited correspondingly in scope, but includes all changes and modifications coming within the spirit and terms of the claims appended hereto.

What is claimed is:

1. A muffler for coupling to an exhaust port of an internal combustion engine, said muffler comprising:

a housing having an outlet for expelling treated exhaust gas from said housing;

a first hollow body within said housing having an inner surface at least partially defining a first chamber within said first hollow body, an outer surface, an inlet providing fluid communication between said first chamber and the exhaust port to admit exhaust gas from the internal combustion engine into said first chamber, and an outlet;

a catalyzer within said first chamber for exothermally treating exhaust gas; and a second hollow body within said housing having an inner surface cooperating with said outer surface of said first hollow body to at least partially define a second chamber within said second hollow body in fluid communication with said outlet of said first hollow body, and an outlet spaced from said outlet of said first hollow body such that exhaust gas flows across at least a portion of said outer surface of said first hollow body in said second chamber for thermally reacting exhaust gas flowing in said second chamber.

2. The muffler according to claim 1, wherein said inlet to said first hollow body is located adjacent the exhaust port and said outlet from said first hollow body is located remote from the exhaust port such that the exhaust gas flows through said first chamber in a direction away from the exhaust port.

3. The muffler according to claim 1, wherein said outlet of said second hollow body is provided with a louver adapted for directing exhaust gas in an opposite direction of flow than in said second chamber.

4. The muffler according to claim 3, wherein said outlet of said second hollow body is located at an end of said second hollow body adjacent the engine such that exhaust gas flows through said second chamber in a direction toward the engine.

5. The muffler according to claim 4, wherein said outlet of said second hollow body is provided with a louver adapted for directing exhaust gas in a direction away from the engine.

6. The muffler according to claim 1, further comprising a flame arrestor screen across said outlet of said second body.

7. The muffler according to claim 1, wherein said first and second hollow bodies are each tubularly-shaped with first and second ends, said housing closes said first end of each of said first and second hollow bodies, and said muffler further comprises a reflector closing said second end of each of said first and second hollow bodies.

8. The muffler according to claim 7, wherein at least a portion of said reflector is spaced from an inner surface of said housing.

9. The muffler according to claim 1, wherein said housing has a louver for directing the treated exhaust gas expelled from said housing in a direction away from the engine.

10. The muffler according to claim 9, wherein a flow of the treated exhaust gas expelled from said housing creates a low pressure zone in said louver and said louver has an opening so that ambient air is drawn into said low pressure zone to mix said ambient air with said treated exhaust gas and cool said treated exhaust gas.

11. The muffler according to claim 1, wherein said outer surface of said first hollow body is provided with a catalytic coating.

12. A muffler for coupling to an exhaust port of an internal combustion engine, the muffler comprising:

a housing having an inner surface;

a first hollow body within said housing and having an outer surface, an inner surface at least partially defining a first chamber, and an inlet for admitting exhaust gas into said first chamber;

a catalyzer within said first hollow body for exothermally treating exhaust gas;

a second hollow body within said housing and having an inner surface and an outer surface, said inner surface of said second hollow body cooperating with said outer surface of said first hollow body to at least partially define a second chamber, said outer surface of said second hollow body cooperating with said inner surface of said housing to at least partially define a third chamber;

wherein said first hollow body has an outlet providing fluid communication between said first chamber and said second chamber, said second hollow body has an outlet providing fluid communication between said second chamber and said third chamber, and said housing has an outlet for expelling treated exhaust gas from said third chamber.

13. The muffler according to claim 12, wherein the outlets of the first and second hollow bodies are located such that exhaust gas flows across at least a portion of said outer surface of said first hollow body as the exhaust gas flows in said second chamber from the first hollow body outlet toward the second hollow body outlet.

14. The muffler according to claim 13, wherein said outlet of said second hollow body is provided with a louver adapted for directing exhaust gas in a direction opposite a direction of exhaust gas flowing in said second chamber.

15. The muffler according to claim 12, wherein said inlet of said first hollow body is located adjacent the exhaust port and said outlet of said first hollow body is located remotely from the exhaust port and said inlet such that exhaust gas flows through said first chamber in a direction away from the exhaust port.

16. The muffler according to claim 15, wherein said outlet of said second hollow body is located at an end of said second hollow body adjacent the engine such that exhaust gas flows through said second chamber in a direction toward the engine.

17. The muffler according to claim 16, wherein said outlet of said second hollow body is provided with a louver adapted for directing exhaust gas in a direction away from the engine.

18. The muffler according to claim 12, further comprising a flame arrestor screen across said outlet of said second hollow body.

19. The muffler according to claim 12, wherein said first and second hollow bodies are each tubularly-shaped with first and second ends, said housing closes said first end of each of said first and second hollow bodies, and said muffler further comprises a reflector closing said second end of each of said first and second hollow bodies.

20. The muffler according to claim 19, wherein said reflector is spaced from an inner surface of said housing.

21. The muffler according to claim 12, wherein said housing has a louver for directing the treated exhaust gas expelled from said housing in a direction away from the engine.

22. The muffler according to claim 21, wherein a flow of the treated exhaust gas expelled from the housing creates a low pressure zone in said louver and said louver has an opening so that ambient air is drawn into said low pressure zone to mix said ambient air with said treated exhaust gas and cool said treated exhaust gas.

23. The muffler according to claim 12, wherein said outer surface of said first hollow body is provided with a catalytic coating.

24. A portable tool powered by an internal combustion engine, said portable tool comprising:

an internal combustion engine having a cylinder with an exhaust port for expelling exhaust gas from said cylinder after combustion;

a muffler comprising a housing having an outlet for expelling treated exhaust gas from said housing, a first hollow body within said housing, a catalyzer within said first hollow body for exothermally treating exhaust gas, and a second hollow body within said housing, said first hollow body having an inner surface at least partially defining a first chamber, an outer surface, an inlet providing fluid communication between said first chamber and said exhaust port to admit exhaust gas into said first chamber, and an outlet, said second hollow body having an inner surface cooperating with said outer surface of said first hollow body to at least partially define a second chamber within said second hollow body in fluid communication with said outlet of said first hollow body, and an outlet spaced from said outlet of said first hollow body such that exhaust gas flows across at least a portion of said outer surface of said first hollow body in said second chamber for thermally reacting the exhaust gas; and fastening means for retaining said muffler against said cylinder.

25. The portable tool according to claim 24, wherein said inlet of said first hollow body is located adjacent said exhaust port and said outlet of said first hollow body is located remote from said inlet and said exhaust port such that exhaust gas flows through said first chamber in a direction away from said exhaust port.

26. The portable tool according to claim 25, wherein said outlet of said second hollow body is located at an end of said second hollow body adjacent said engine such that exhaust gas flows through said second chamber in a direction toward said engine.

27. The portable tool according to claim 26, wherein said outlet of said second hollow body is provided with a louver adapted for directing exhaust gas in a direction away from said engine.

28. The portable tool according to claim 24, said muffler further comprising a flame arrestor screen across the outlet of said second hollow body.

29. The portable tool according to claim 24, wherein said muffler housing has a louver for directing the treated exhaust gas expelled from said housing in a direction away from said engine.

30. The portable tool according to claim 29, wherein a flow of the treated exhaust gas expelled from said housing creates a low pressure zone in said louver and said louver has an opening so that ambient air is drawn into said low pressure zone to mix said ambient air with said treated exhaust gas and cool said treated exhaust gas.

31. The portable tool according to claim 24, wherein said outer surface of said first hollow body is provided with a catalytic coating.

* * * * *